US006253818B1

(12) United States Patent
Preinknoll

(10) Patent No.: US 6,253,818 B1
(45) Date of Patent: Jul. 3, 2001

(54) DEVICE FOR CHANGING REELS AT PAPER MACHINES

(75) Inventor: Ernst Preinknoll, Graz (AT)

(73) Assignee: Andritz-Patentverwaltungs-Gesellschaft m.b.H., Graz (AT)

( * ) Notice: Subject to any disclaimer, the term of this patent is extended or adjusted under 35 U.S.C. 154(b) by 0 days.

(21) Appl. No.: 09/228,604

(22) Filed: Jan. 12, 1999

(30) Foreign Application Priority Data

Jan. 13, 1998 (AT) ..... A28/98

(51) Int. Cl.[7] ..... B65H 19/00; B65H 19/28

(52) U.S. Cl. ..... 156/389; 156/446; 156/458; 156/459; 156/578; 156/187

(58) Field of Search ..... 156/187, 389, 156/578, 446, 459, 458; 242/532.3

(56) References Cited

U.S. PATENT DOCUMENTS 3,951,890 * 4/1976 Reilly et al. ..... 242/532.3
4,338,147 * 7/1982 Backstrom et al. ..... 156/187
4,488,687 * 12/1984 Andreasson ..... 242/56 A
4,572,451 * 2/1986 Ikeda et al. ..... 242/532.3
4,711,405 * 12/1987 Niskanen ..... 242/532.3
5,009,736 * 4/1991 Lehto ..... 242/532.3

* cited by examiner

*Primary Examiner*—Jeff H. Aftergut
(74) *Attorney, Agent, or Firm*—Alix, Yale & Ristas, LLP

(57) ABSTRACT

The invention refers to a process for changing reels at paper machines, particularly tissue machines. It is mainly characterized by adhesive being applied to an empty reel over almost the entire web width, the core shaft being placed thus prepared on the moving paper web, the paper web being detached across its entire width from the reel currently in use, then secured immediately to the empty core shaft as the paper continues to be wound on the reel. In addition, the invention refers to a device for implementing the process, where an adhesive application device is provided, which is installed on a movable mounting on a winding device at least above the paper web area, at right angles to the web running direction.

12 Claims, 5 Drawing Sheets

DEVICE FOR CHANGING REELS AT PAPER MACHINES

BACKGROUND OF THE INVENTION

1. Field of the Invention

The invention relates to methods and apparatus for changing paper accumulating reels utilized with paper tissue machines.

2. Description of the Related Art

In conventional paper machines for producing a paper web of a given width, the web of paper produced by the paper machine is wound around reels. As each reel becomes filled, it is replaced by an empty reel using a process which entails applying air and water. On high-speed paper machines, operators also use adhesive sprays, which should not be used in tissue production, or adhesive strips applied to the empty reels.

Usually, the reels are changed using a transfer tail, which is a narrow strip taken from the entire web width. This so-called "tail cutting" of the paper web requires virtually perfect operation of the tail cutter or web slitting device. In crescent formers, where web formation takes place between wire and felt, this process is made even more difficult because the web has to be detached from the felt. If the web is not detached completely, the reel changing process is seriously jeopardized. In addition to these dangers to production, "tail cutting" also causes a loss of production.

SUMMARY OF THE INVENTION

By contrast to the related art, the present invention is directed to transferring the entire paper web, being dispensed from the paper machine, from one substantially full reel to the next (empty) reel without loss of production and while maintaining a high level of operating reliability.

According to the invention, this is achieved by (1) applying adhesive to a core shaft portion of an empty reel over a region which is substantially entirely the same width of the entire web, (2) placing the core shaft portion thus prepared on the paper web being dispensed to thereby adhere the paper web to the core shaft portion of the empty reel, (3) detaching the paper web from the substantially full reel, and (4) immediately winding the detached web around the core shaft portion of the empty reel. By applying the adhesive over almost the entire width of the paper web, the "tail cutting" process that was previously necessary is avoided and, thus, a complete paper web is always produced over the entire width.

A further development of the invention is characterized by the paper web being glued onto the empty core shaft using an adhesive with good initial adhesive force. This boosts the operating reliability and, as a result, the risk of web breakage, and the loss of production web breakage involved, is kept to a minimum.

An advantageous configuration of the invention is characterized by the adhesive power disappearing after a while, allowing the paper to be removed easily from the empty core shaft at a later point in time. With this arrangement the paper can be wound onto another reel during finishing without any losses and the empty core shaft used again for winding the paper web onto a reel without requiring additional treatment.

A further favorable development of the invention entails adjusting the amount of adhesive applied to a new empty reel. As a result, the optimum amount of adhesive can always be applied, even with changing production conditions, e.g., different basis weights or web speeds.

Another favorable configuration of the invention is characterized by the adhesive application device being moved into a parking position after each application of adhesive to a reel. Thus, the adhesive application device can be cleaned, especially rinsed, after each application. By moving the application device into a parking position, the application nozzle can be rinsed, checked, and also changed if necessary during operations. Since the nozzle is cleaned after every application, an optimum and even supply of adhesive is always guaranteed for the next application. This also enhances the operating reliability of the plant.

The invention is also directed to a device for changing the reels at a paper machine, particularly a tissue machine. According to the invention, it is characterized by an adhesive application device being provided and which is installed on a movable mounting of a winding device at least above the paper web area, at right angles to the web running direction. With this arrangement, adhesive can be applied evenly to an empty core shaft over virtually the entire width, with the result that the paper web can then be removed evenly and simultaneously over the entire width, and wound onto the empty core shaft without any losses of production due to "tail cutting".

A further favorable development of the invention is characterized by the adhesive application device having connections for the adhesive, control air, spraying air and cleaning agent.

Another advantageous configuration of the invention is characterized by the parking position location being provided outside the machine and into which the adhesive application device can be moved. As a result, the adhesive application nozzle can also be cleaned, inspected and replaced while the paper machine is in operation.

Still another favorable configuration of the invention is characterized by the adhesive application device having a nozzle, which is fitted with a needle to control the amount of adhesive flowing out of the nozzle, where the nozzle may have an adjustable limit stop for the needle stroke in order to set the amount of adhesive. With the aid of the needle, the nozzle hole can be opened and closed at the correct time, and the amount of adhesive flowing therefrom is always at an optimum because the nozzle is adjustable.

A further advantageous development of the invention is characterized by the adhesive application device being secured to a retaining bracket mounted at right angles to the web running direction, where the distance between the retaining bracket and the empty core shaft is adjustable. Since the height of the retaining bracket can be adjusted in relation to the empty core shaft, it is possible to set the approximate position of the spraying cone.

BRIEF DESCRIPTION OF THE DRAWINGS

The preferred embodiments of the present invention will now be described with reference to the drawings, wherein like numerals represent like structures and wherein.

DESCRIPTION OF THE PREFERRED EMBODIMENT

Figure 1:
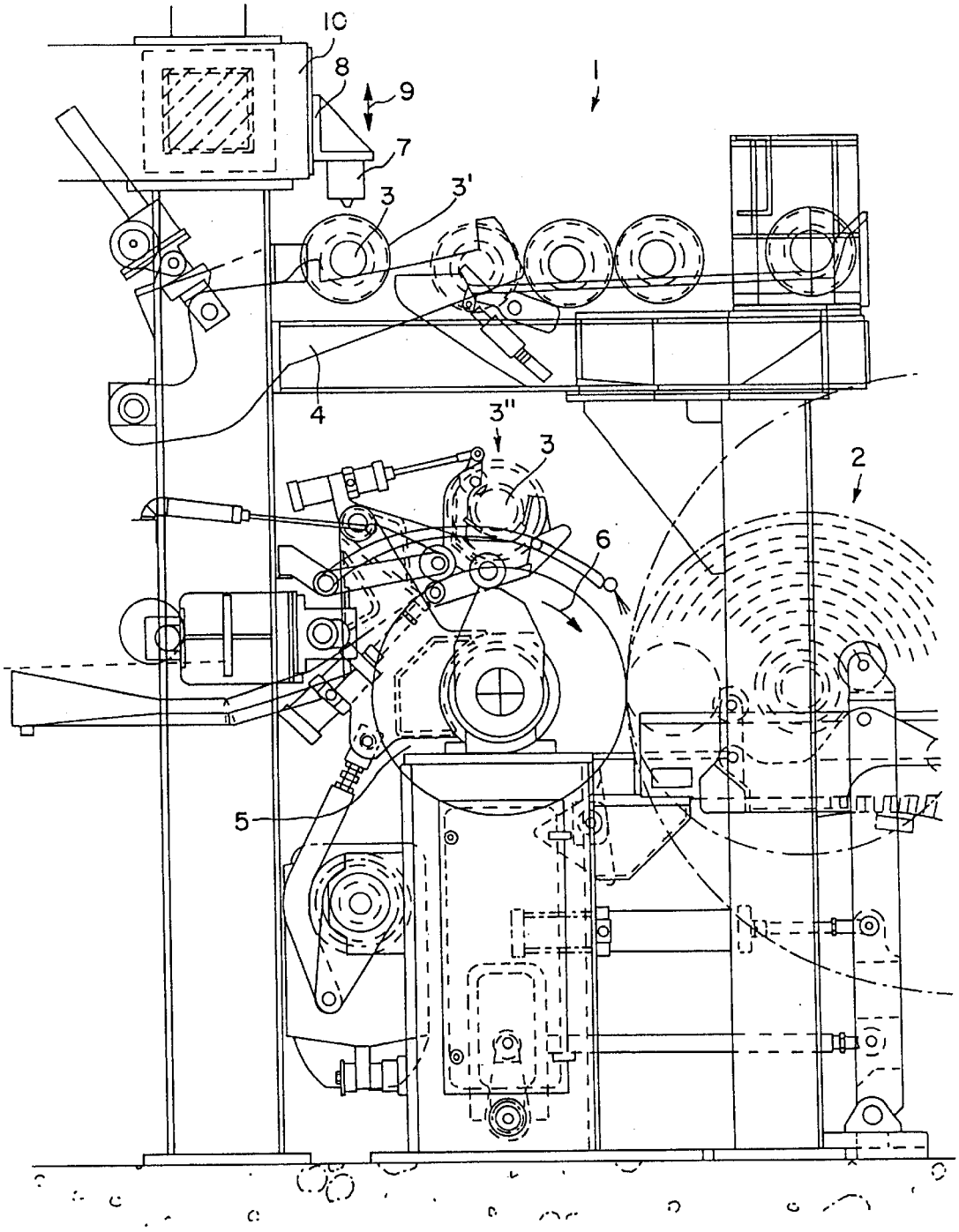
FIG. 1 shows the arrangement of the device according to the invention on the winding unit of a paper machine.

FIG. 1 shows the arrangement of a winding device 1 o,n a paper machine, particularly a tissue paper machine where the paper is wound onto a reel 2. The empty reel spool 3 has a core shaft 3' and is moved by a lever 4 from a storage area into position 3" to a carrier roll 5. From there, the reel spool 3 is swivelled in direction 6 towards the full reel 2, at which time the paper is detached across its entire width and continues winding immediately afterwards onto the empty reel spool 3.

An adhesive application device 7 is located above the storage position of the empty reel spool 3 and is used to apply adhesive to the empty core shaft portion 3' of empty reel 3. The adhesive application device 7 is secured to a retaining bracket 8 which is mounted on a cross-beam 10 of the winding device 1 and can be adjusted in direction 9.

Figure 2:
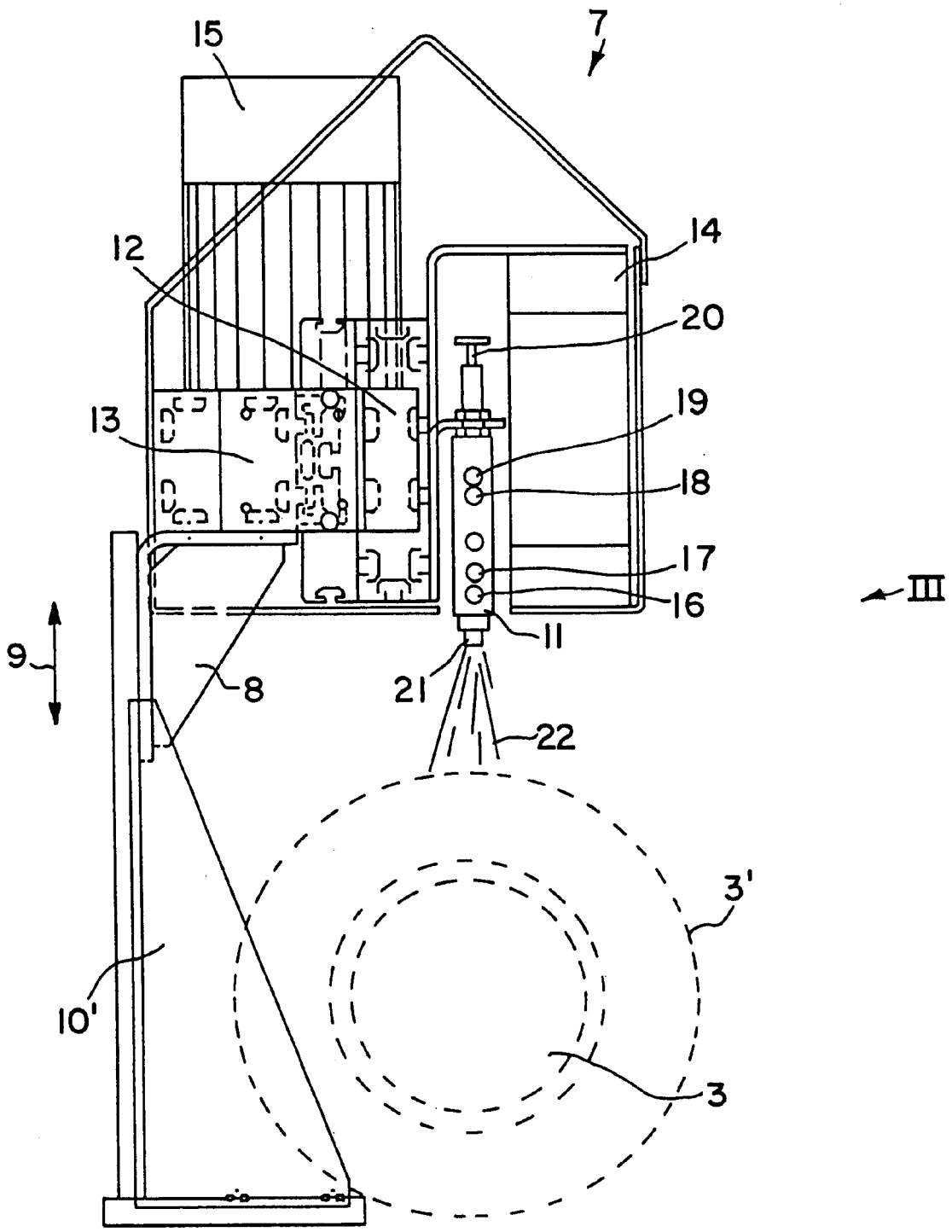
FIG. 2 shows an adhesive application device according to the invention.

FIG. 2 illustrates an adhesive application device 7 according to the invention and an empty reel spool 3. The retaining bracket 8 is secured to a beam. 10' designed differently from the bracket shown in FIG. 1 and which can also be adjusted in direction 9. The adhesive application device 7 has a nozzle 11, which is secured to a traveler 12 running on a rail 13. The required connecting pipes, e.g. for spraying air, control air, adhesive, and cleaning agent for the nozzle 11, are carried in an energy chain 14. The drive for the traversing movement is marked 15. The nozzle 11 has an adhesive connection 16, a connection for cleaning agent 17, for diffusing air 18 and for control air 19. The control air causes a needle 20 which normally closes nozzle 11, to be raised whereby the outlet 21 opens at the correct moment, i.e. when the adhesive application device 7 passes over the edge of the paper web. This outlet 21 is preferably located somewhere between 20 and 30 mm above the surface of the reel spool 3. Just before it passes over the other edge of the paper web, the outlet 21 is closed again by the needle 20. The adhesive fed through the adhesive connection 16 is applied to the core shaft 3' on the reel spool by means of diffusing air 18. This is effected by a diffuser cone 22, which has an impact width of somewhere between 25 and 45 mm, for example, on the surface of the reel spool 3. The best results were achieved in this range during tests. The impact width and the quantity of adhesive can be adjusted to the optimum for the given requirements by setting the maximum stroke of the needle 20.

Figure 3:
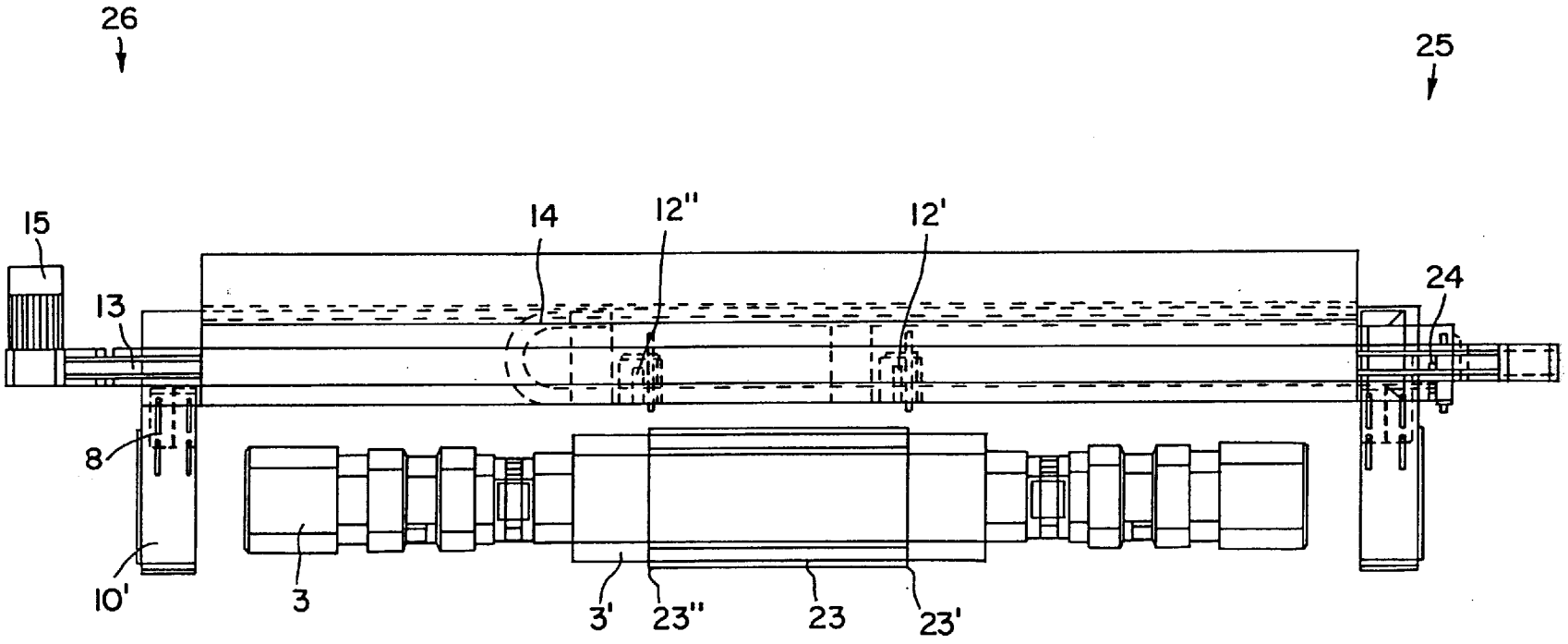
FIG. 3 is a front elevation view of the adhesive application device in combination with an empty core shaft, the view of FIG. 3 being in the direction of arrow III in FIG. 2.

FIG. 3 provides a view according to arrow III in FIG. 2. This illustration clearly shows that the traveler 12, to which the nozzle 11 is secured, moves between position 12' at the edge 23' of the paper web 23 and position 12" at the other edge 23" while the adhesive is applied. After the adhesive has been applied, the traveler 12 moves into a parking position 24 located on one side 25 of the paper machine. In this parking position 24, the nozzle 11 is cleaned using a cleaning agent so that it is in full working order again for the next adhesive application process. In addition, the nozzle can be checked in this position while the paper machine is in operation and also replaced if necessary. The drive 15 is located on the drive side 26 (i.e., the side on which the drives are mounted) of the paper machine.

Figure 4:
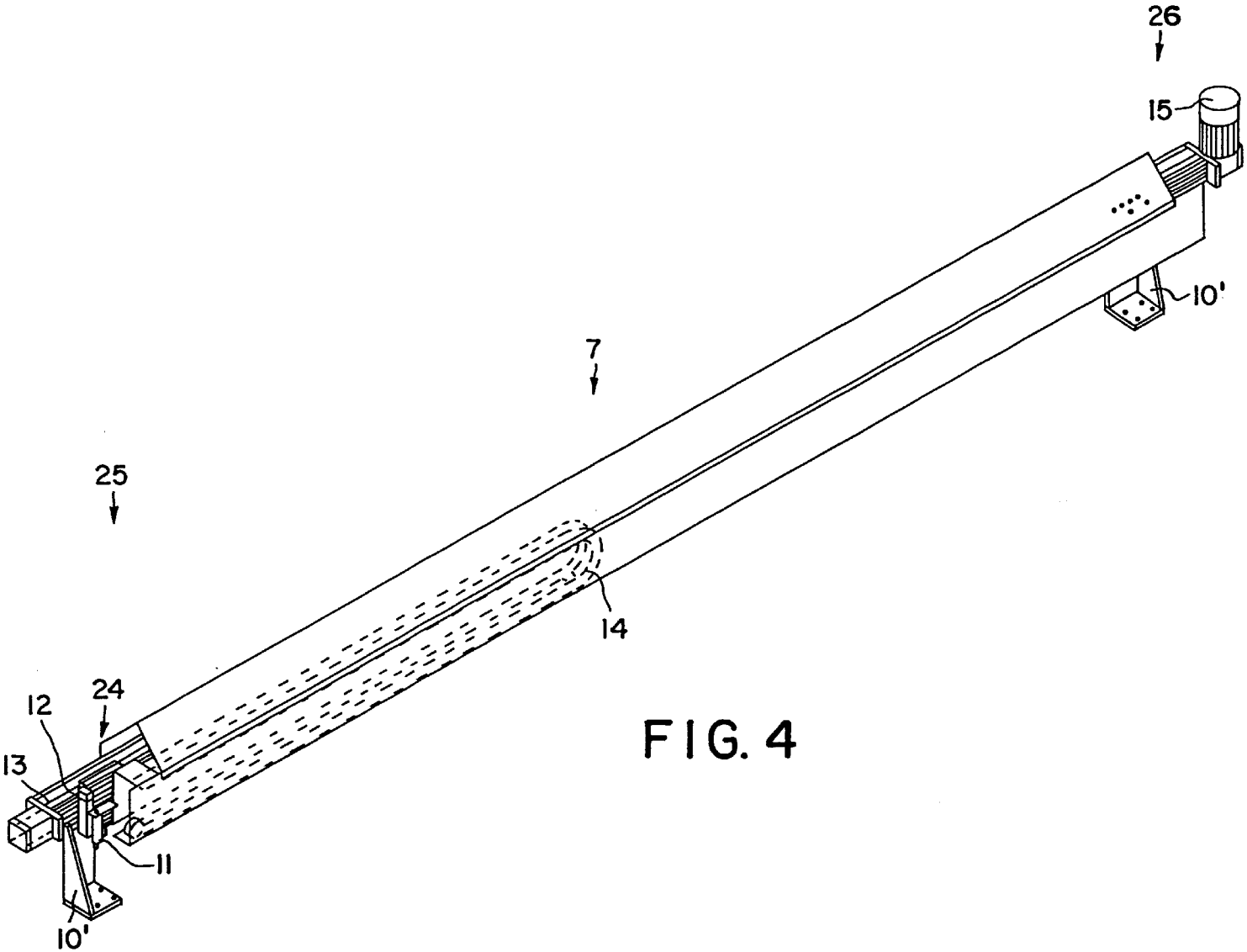
FIG. 4 contains a perspective illustration of the entire adhesive application device.

FIG. 4 shows a perspective illustration of the adhesive application device 7 which is shown with the traveler 12 carrying the nozzle 11 in the parking position 24 on the tender side 25 (i.e., the side on which operators may check the machine) of the paper machine.

Figure 5:
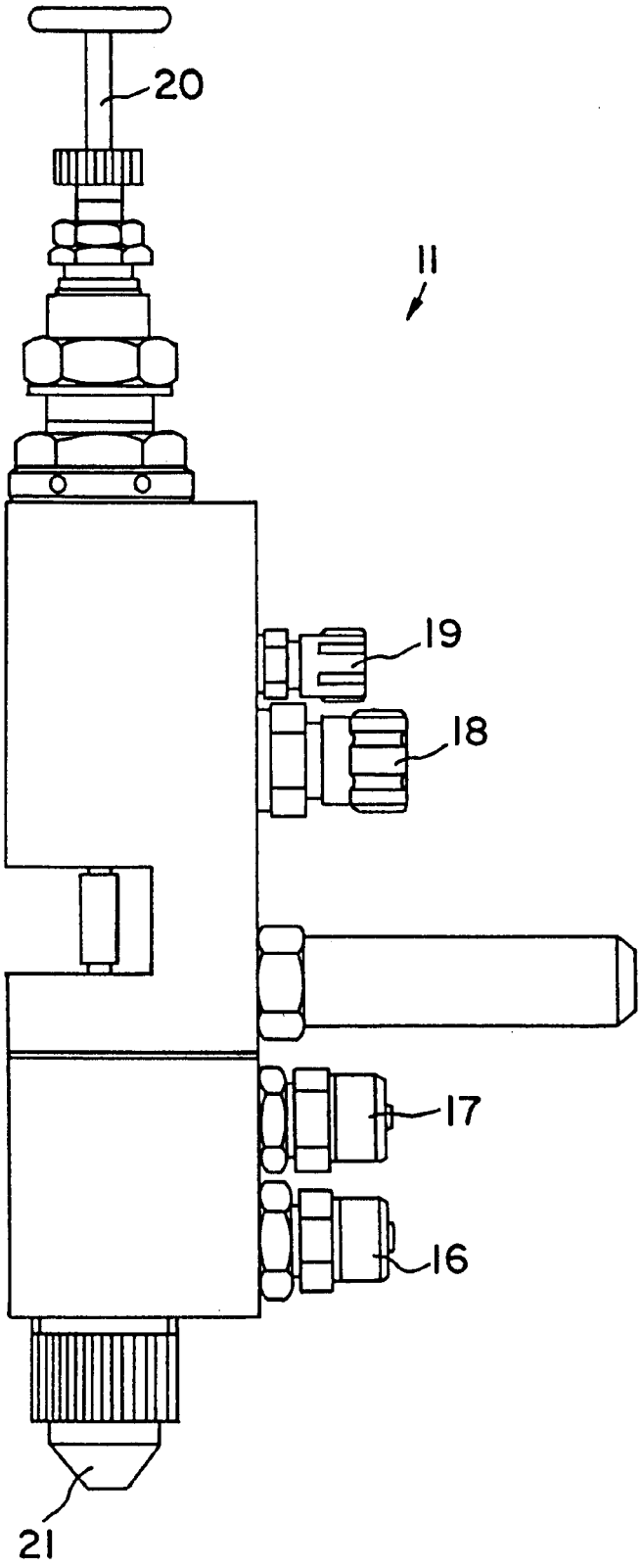
FIG. 5 illustrates an alternative embodiment of the adhesive application nozzle.

FIG. 5 shows an alternative configuration of a nozzle 11 with the adhesive connection 16, cleaning agent connection 17, diffusing air connection 18, and control air connection 19. This illustration also shows the top part of the needle 20 which closes the outlet 21.

In tests at machine speeds beyond 1500 m/min, the best results were obtained with drying times between 5 and 12 minutes, as well as impact widths of 25 to 45 mm on the surface of the empty reel spool. By detaching the paper web simultaneously over this entire width, it was possible to avoid the production losses associated with conventional processes when changing the reels, and there were also no web breaks. The devices according to the invention can be installed not only in newly built plants and machines, but can also be added to existing paper machines. Since the adhesive used in the inventive process is water-soluble, the broke (i.e., waste paper which accumulates after a break of the paper web) can also be recycled and re-used in the process without causing any problems.

The invention is not limited to the specific examples described herein. The adhesive application device, for example, can be mounted above the waiting position of the reel, above the carrier roll or on/at the guide plate for the transfer tail instead of above the swing-down position at the reel magazine. It is highly desirable, however, that the nozzle be cleaned, checked and changed during operation while in the parking position.

What is claimed is:

1. An apparatus for applying an adhesive to a core shaft portion of a reel used with a paper machine which produces a paper web having a paper web area and which dispenses the paper web in a running direction, the paper machine having a winding device with a movable mounting, said apparatus comprising:

an adhesive dispensing device installed on the movable mounting at least above the paper web area, said device dispensing adhesive at least substantially normal to the web running direction and being moveable between an adhesive-application position which is at least in proximity to the paper web area and a parking position which is not in proximity to the paper web area and cleaning means for cleaning the adhesive dispensing device when it is in the parking position.

2. The apparatus of claim 1 wherein said adhesive dispensing device further comprises connections for the adhesive, control air, spraying air and a cleaning agent.

3. The apparatus of claim 1 wherein said apparatus further comprises means for moving said adhesive dispensing device between said adhesive-application and parking positions.

4. The apparatus of claim 2 wherein said apparatus further comprises means for moving said adhesive dispensing device between said adhesive-application and parking positions.

5. The apparatus of claim 1 wherein said apparatus includes a nozzle through which the adhesive may flow, said nozzle being fitted with a movable needle to control the amount of adhesive flowing through said nozzle.

6. The apparatus of claim 2 wherein said apparatus includes a nozzle through which the adhesive may flow, said nozzle being fitted with a movable needle to control the amount of adhesive flowing through said nozzle.

7. The apparatus of claim 4 wherein said apparatus includes a nozzle through which the adhesive may flow, said nozzle being fitted with a movable needle to control the amount of adhesive flowing through said nozzle.

8. The apparatus of claim 5 wherein said nozzle further comprises an adjustable limit-stop for limiting movement of the needle to thereby set the flow rate of the adhesive through the nozzle.

9. The apparatus of claim 1 wherein said adhesive dispensing device further comprises a retaining bracket for affixing said apparatus to the paper machine, said retaining bracket being mounted to the paper machine at right angles to the web running direction.

10. The apparatus of claim 2 wherein said adhesive dispensing device further comprises a retaining bracket for affixing said apparatus to the paper machine, said retaining bracket being mounted to the paper machine at right angles to the web running direction.

11. The apparatus of claim 5 wherein said adhesive dispensing device further comprises a retaining bracket for affixing said apparatus to the paper machine, said retaining bracket being mounted to the paper machine at right angles to the web running direction.

12. The apparatus of claim 9 further comprising means for adjusting the distance between said retaining bracket and the core shaft portion of the reel.

* * * * *